US007721363B2

(12) United States Patent
Huang

(10) Patent No.: US 7,721,363 B2
(45) Date of Patent: May 25, 2010

(54) SLIDE RAIL

(75) Inventor: Ting-Yao Huang, Changhua Hsien (TW)

(73) Assignee: Sheng Tai Brassware Co., Ltd., Changhua Hsien (TW)

( * ) Notice: Subject to any disclaimer, the term of this patent is extended or adjusted under 35 U.S.C. 154(b) by 160 days.

(21) Appl. No.: 12/147,788

(22) Filed: Jun. 27, 2008

(65) Prior Publication Data

US 2009/0321599 A1 Dec. 31, 2009

(51) Int. Cl.
*A47K 3/022* (2006.01)
*A47K 3/28* (2006.01)

(52) U.S. Cl. ..... 4/605; 4/567; 4/615; 4/597; 248/230.3; 248/228.3; 248/227.3; 248/231.41; 248/313; 248/316.1; 248/122.1; 248/125.1; 248/125.3; 248/295.11

(58) Field of Classification Search ..... 248/230.3, 248/228.3, 227.3, 231.41, 307, 313, 316.1, 248/122.1, 125.1, 125.3, 295.11; 4/567, 4/568, 570, 605, 615, 597
See application file for complete search history.

(56) References Cited

U.S. PATENT DOCUMENTS 4,365,778 A * 12/1982 Joussemet ..... 248/250
4,867,404 A * 9/1989 Harrington et al. ..... 606/46
4,964,573 A * 10/1990 Lipski ..... 239/283
5,265,833 A * 11/1993 Heimann et al. ..... 248/75
5,481,765 A * 1/1996 Wang ..... 4/605
5,979,840 A * 11/1999 Hollister et al. ..... 248/76
5,996,946 A * 12/1999 Bailey ..... 248/125.1
6,024,331 A * 2/2000 Bischoff et al. ..... 248/229.1
6,093,878 A * 7/2000 Hoshino ..... 84/421
6,334,594 B1 * 1/2002 Bailey ..... 248/125.1
6,342,138 B1 * 1/2002 Brown ..... 204/297.09
6,450,462 B1 * 9/2002 Hsieh ..... 248/125.1
6,453,486 B1 * 9/2002 Chen ..... 4/605
6,473,916 B2 * 11/2002 Schiødt ..... 4/567
7,197,776 B2 * 4/2007 Tsai ..... 4/615
7,458,112 B1 * 12/2008 Yang ..... 4/601
2007/0245483 A1 * 10/2007 Eilmus et al. ..... 4/567
2008/0121765 A1 * 5/2008 Fetzer ..... 248/122.1
2009/0308998 A1 * 12/2009 Felmeri ..... 248/295.11

* cited by examiner

*Primary Examiner*—Anita M King
*Assistant Examiner*—Nkeisha J Smith
(74) *Attorney, Agent, or Firm*—Rabin & Berdo, P.C.

(57) ABSTRACT

A slide rail has a mounting shaft and a sliding mount. The sliding mount is movably mounted around the mounting shaft and has a clamp, a handle, a clamp jaw, a holding bracket and a spring. The clamp is mounted around the mounting shaft. The handle is rotatably connected to the clamp and has a lock bar and a grip. The clamp jaw is mounted around and abuts the mounting shaft in the clamp and has a convex surface. The holding bracket is connected to the clamp to hold a shower-head, a soap dish or the like and has a positioning ring. The spring is mounted in the clamp between the clamp jaw and the positioning ring to push the convex surface of the clamp jaw to engage an engaging recess of the lock bar.

15 Claims, 7 Drawing Sheets

SLIDE RAIL

BACKGROUND OF THE INVENTION

1. Field of the Invention

The present invention relates to a slide rail, more particular to a slide rail for holding sanitary devices conveniently.

2. Description of Related Art

With reference to FIG. 7, a conventional slide rail (60) is mounted on a wall for holding sanitary devices such as showerhead, soap dish or the like and has a mounting shaft (61) and a sliding mount (62). The mounting shaft (61) is mounted on a wall and has an external surface and a diameter. The sliding mount (62) is movably mounted around the mounting shaft (61) and has a clamp (63), a holding bracket (64), an handle (65) and a pressing rod (66).

The clamp (63) is hollow, is mounted around the mounting shaft (61) and has a center, two ends, a mounting hole (631) and a connecting hole (632). The mounting hole (631) is formed through the center of the clamp (63) and is mounted around the external surface of the mounting shaft (61). The connecting hole (632) is formed in one of the ends of the clamp (63) and communicates with the mounting hole (631).

The holding bracket (64) is connected to the clamp (63) by a fastener (67) opposite to the connecting hole (632) to hold a showerhead bracket, soap dish or the like.

The handle (65) is rotatably mounted in the connecting hole (632) of the clamp (63) and has an inner end and a threaded hole (651). The inner end of the handle (65) is mounted in the connecting hole (632) and extends into the clamp (63). The threaded hole (651) is formed in the inner end of the handle (65) and communicates with the mounting hole (631).

The pressing rod (66) is mounted in the threaded hole (651) of the handle (65) to press against the external surface of the mounting shaft (61) and has a pressing hole (661). The pressing hole (661) is formed through the pressing rod (66) and is mounted around the mounting shaft (61) in the clamp (63) and has a diameter larger than the diameter of the mounting shaft (61).

The position of the sliding mount (62) of the conventional hanger device (60) can be adjusted relative to the mounting shaft (61) by rotating the handle (65) to make the pressing rod (66) separate from the external surface of the mounting shaft (66). Then, the sliding mount (62) can be moved relative to the mounting shaft (61).

However, the external surface of the mounting shaft (61) is subject to wear by over-rotation of the pressing rod (66) forming a dent on the external surface of the mounting shaft (61), and this will make the sliding mount (62) slanting relative to the mounting shaft when the pressing rod (66) is pressed on the dent on the external surface of the mounting shaft (61). Then, the life of the mounting shaft (61) will be shortened and the mounting shaft (61) needs to be replaced.

Furthermore, the handle (65) is a circular shape, and a user cannot distinguish when the pressing rod (66) is pressing against the mounting shaft (61). Then, the conventional slide rail is inconvenient in use.

To overcome the shortcomings, the present invention tends to provide a slide rail to mitigate or obviate the aforementioned problems.

SUMMARY OF THE INVENTION

The primary objective of the present invention is to provide a slide rail for holding sanitary devices conveniently.

The slide rail in accordance with the present invention has a mounting shaft and a sliding mount. The sliding mount is movably mounted around the mounting shaft and has a clamp, a handle, a clamp jaw, a holding bracket and a spring. The clamp is mounted around the mounting shaft. The handle is rotatably connected to the clamp and has a lock bar and a grip. The clamp jaw is mounted around and abuts the mounting shaft in the clamp and has a convex surface. The holding bracket is connected to the clamp to hold a showerhead, a soap dish or the like and has a positioning ring. The spring is mounted in the clamp between the clamp jaw and the positioning ring to push the convex surface of the clamp jaw to engage an engaging recess of the lock bar to make the clamp jaw abut the external surface of the mounting shaft to hold the sliding mount with the mounting shaft.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
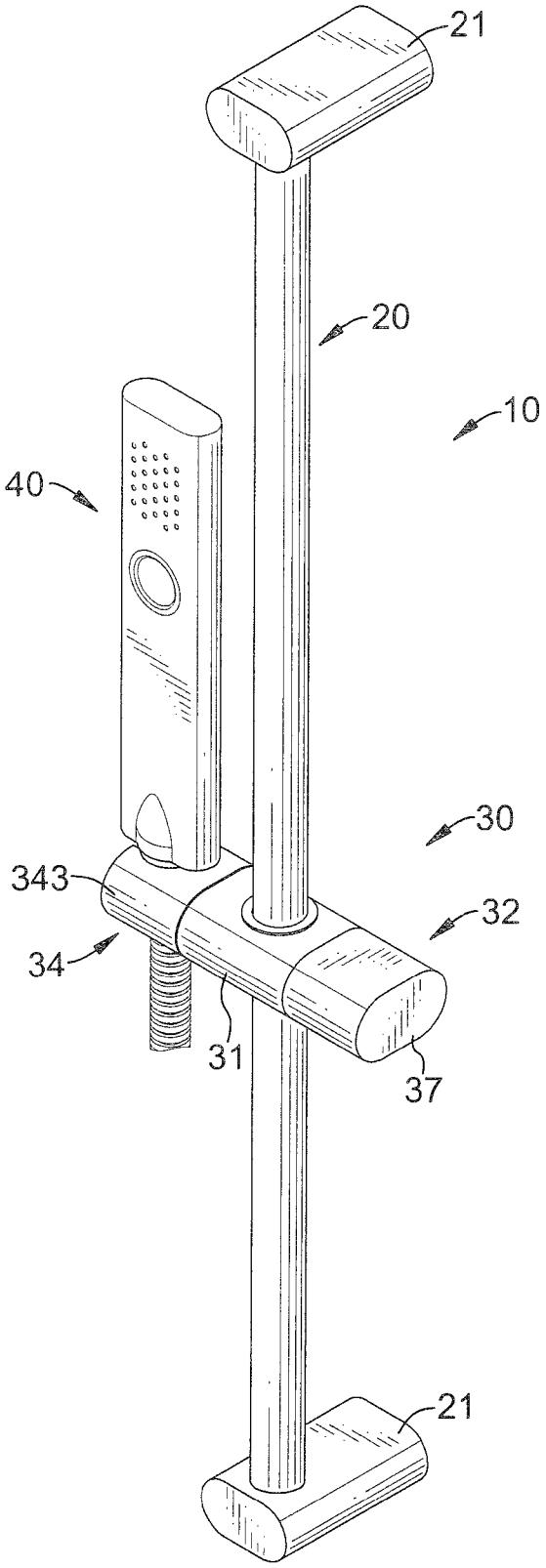
FIG. 1 is a perspective view of a slide rail for holding sanitary devices in accordance with the present invention, shown holding a showerhead.
Figure 2:
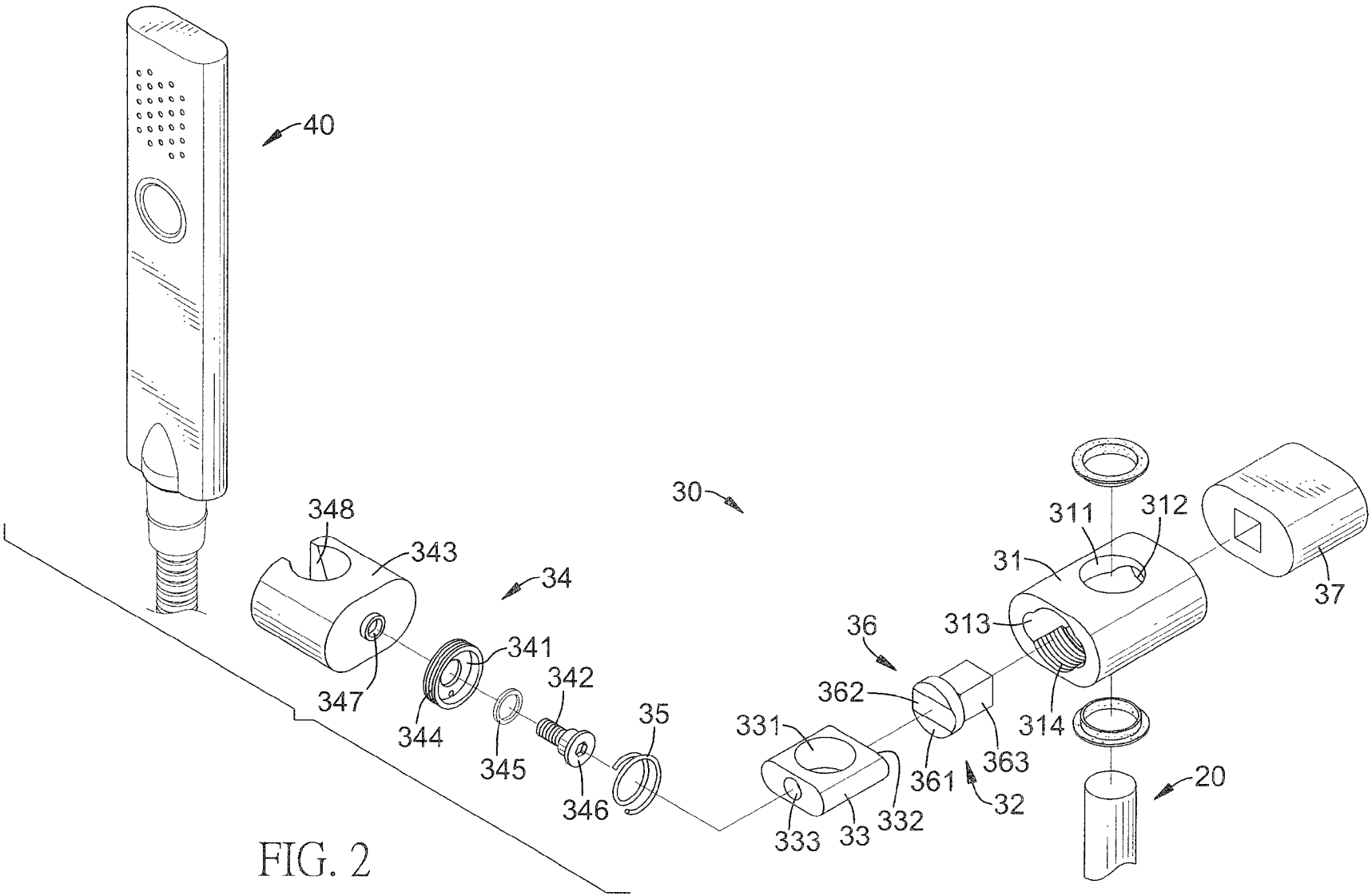
FIG. 2 is an enlarged, exploded perspective view of the slide rail in FIG. 1.
Figure 3:
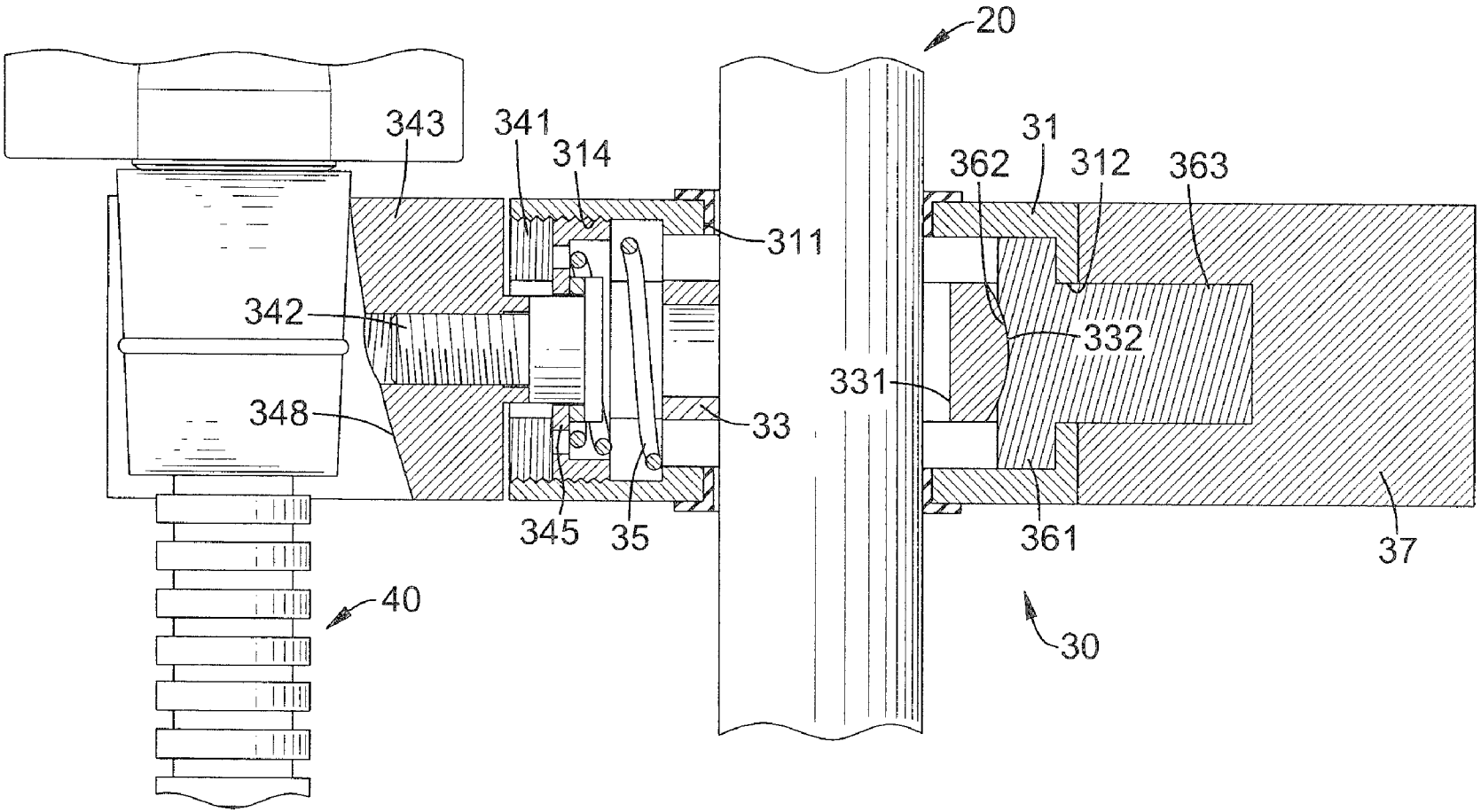
FIG. 3 is an enlarged side view in partial section of the slide rail in FIG. 1, shown locked.

With reference to FIGS. 1 to 3, a slide rail (10) in accordance with the present invention comprises a mounting shaft (20) and a sliding mount (30).

The mounting shaft (20) is mounted on a wall and has an external surface, two ends, a diameter and two mounting blocks (21). The mounting blocks (21) are respectively formed on the ends of the mounting shaft (20) and are mounted on a wall.

The sliding mount (30) is movably mounted around the mounting shaft (20) and has a clamp (31), a handle (32), a clamp jaw (33), a holding bracket (34) and a spring (35).

The clamp (31) may be hollow and elliptical in cross section, is mounted slidably around the mounting shaft (20) and has two mounting surfaces, two ends, an internal surface, two mounting holes (311), two washers, a connecting hole (312), an attaching hole (313) and an inner thread (314). The mounting holes (311) are respectively formed through the mounting surfaces of the clamp (31) aligned with each other and are mounted around the external surface of the mounting shaft (20). The washers are respectively mounted in the mounting holes (311) to prevent the clamp (31) from scuffing the external surface of the mounting shaft (20) and to limit the amount of water entering the clamp (31). The connecting hole (312) is formed in one of the ends of the clamp (31) and communicates with the mounting holes (311). The attaching hole (313) is formed in the other end of the clamp (31) and communicates with the mounting holes (311) and the connecting hole (312). The inner thread (314) is formed on the internal surface of the clamp (31) near the attaching hole (313).

The handle (32) is rotatably connected to the clamp (31) and has a lock bar (36) and a grip (37).

The lock bar (36) is rotatably mounted in the connecting hole (312) of the clamp (31) and has an inner end, an outer end, a pressing panel (361) and an arm (363). The pressing panel (361) is defined in the inner end of the lock bar (36), abuts the internal surface of the clamp (31) near the connecting hole (312) and has a sidewall and an engaging recess (362). The sidewall of the pressing panel (361) faces the external surface of the mounting shaft (20). The engaging recess (362) is formed in the sidewall of the pressing panel (361). The arm (363) is polygonal, is defined in the outer end of the lock bar (36) and is formed on and protrudes from the pressing panel (361) and extends out of the connecting hole (312) of the clamp (31).

The grip (37) is mounted around the arm (363) of the rotating panel (361) and has a shape corresponding to the clamp (31), the shape of the grip may be elliptical in cross-section.

The clamp jaw (33) is mounted in the clamp (31) and around and abuts the mounting shaft (20) and has a center, two sidewalls, a shaft hole (331), a convex surface (332) and a through hole (333). The shaft hole (331) is formed through the center of the clamp jaw (33), is mounted around the external surface of the mounting shaft (20) and has a diameter larger than the diameter of the mounting shaft (20). The convex surface (332) is formed on one of the sidewalls of the clamp jaw (33) and engages the engaging recess (362) of the pressing panel (361). The through hole (333) is formed in the other sidewall of the clamp jaw (33) and communicates with the shaft hole (331).

Figure 6:
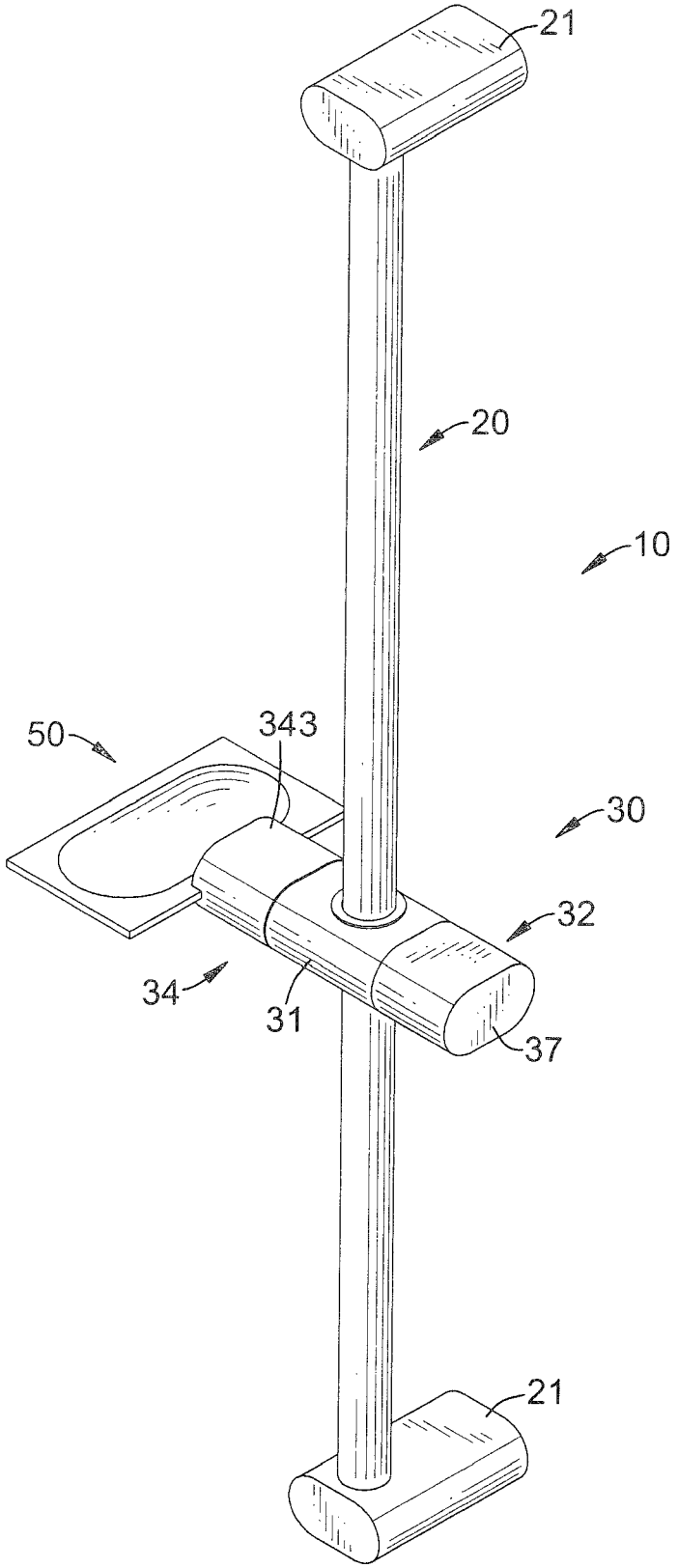
FIG. 6 is a perspective view of the slide rail in FIG. 1, shown holding a soap dish.
Figure 7:
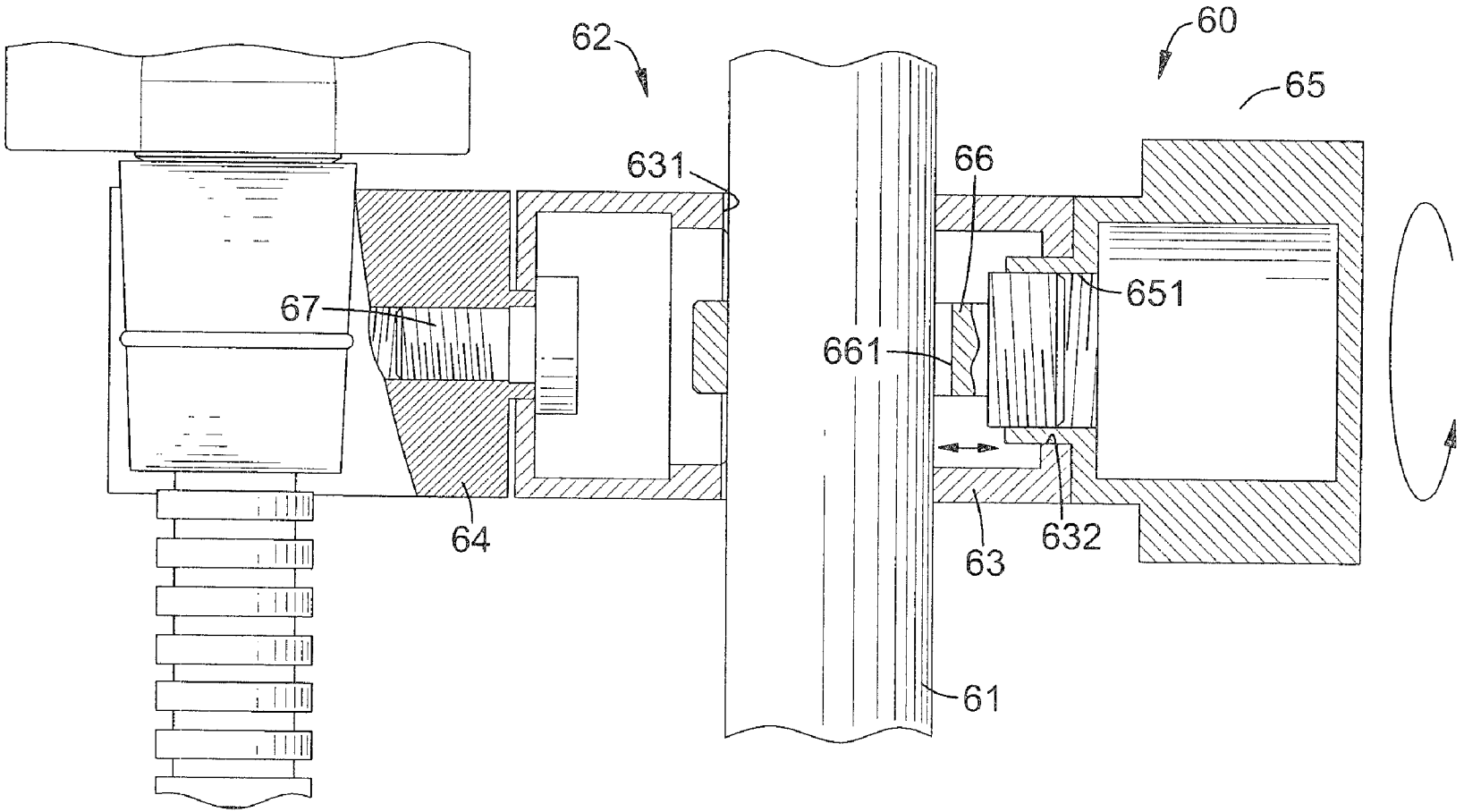
FIG. 7 PRIOR ART
FIG. 7 is an operational side view in partial section of a slide rail in accordance with the prior art.

With further reference to FIG. 6, the holding bracket (34) is connected to the clamp (31) near the attaching hole (313) to hold a showerhead (40), a soap dish (50) or the like and has a positioning ring (341), a fastener (342) and a body (343).

The positioning ring (341) is mounted securely in the clamp (31) near the attaching hole (313) and has an external surface, an outer thread (344) and a washer (345). The outer thread (344) is formed on the external surface of the positioning ring (341) and is screwed with the inner thread (314) in the internal surface of the clamp (31) near the attaching hole (313). The washer (345) of the positioning ring (341) is mounted in the positioning ring (341) and aligns with the through hole (333) of the clamp jaw (33).

The fastener (342) is mounted in the clamp (31) and has an abutting end, a polygonal hole (346) and a connecting end. The abutting end of the fastener (342) is mounted in the clamp (31) and abuts the positioning ring (341), may abut the washer (345) of the positioning ring (341). The polygonal hole (346) is formed in a top of the abutting end of the fastener (342) and aligns with the through hole (333) of the clamp jaw (33). Then, a tool can be inserted to the polygonal hole (346) to rotate the fastener (342) via the mounting hole (311) of the clamp (31), the shaft hole (331) and the through hole (333) of the clamp jaw (33). The connecting end of the fastener (342) extends through the washer (345) of the positioning ring (341), the positioning ring (341) and out of the attaching hole (313) of the clamp (31).

The body (343) of the holding bracket (34) is connected to the fastener (342), abuts with the clamp (34) near the attaching hole (313) and has a shape corresponding to the clamp (31), an inner side, an outer side, a threaded hole (347) and a holding recess (348). The threaded hole (347) is formed in the inner side of the body (343) and is screwed with the connecting end of the fastener (342) to connect the body (343) with the clamp (31) through the fastener (342). The holding recess (348) may be formed longitudinally in the outer side of the body (343) to hold a showerhead (40) or may be formed transversally in the outer side of the body (343) to hold a soap dish (50).

The spring (35) is mounted in the clamp (31) between the clamp jaw (33) and the holding bracket (34) may be the positioning ring (341) of the holding bracket (34) to push the convex surface (332) of the clamp jaw (33) to engage the engaging recess (362) of the pressing panel (361) to make the clamp jaw (33) abut the external surface of the mounting shaft (20) to hold the sliding mount (30) with the mounting shaft (20) as shown in FIG. 3.

Figure 4:
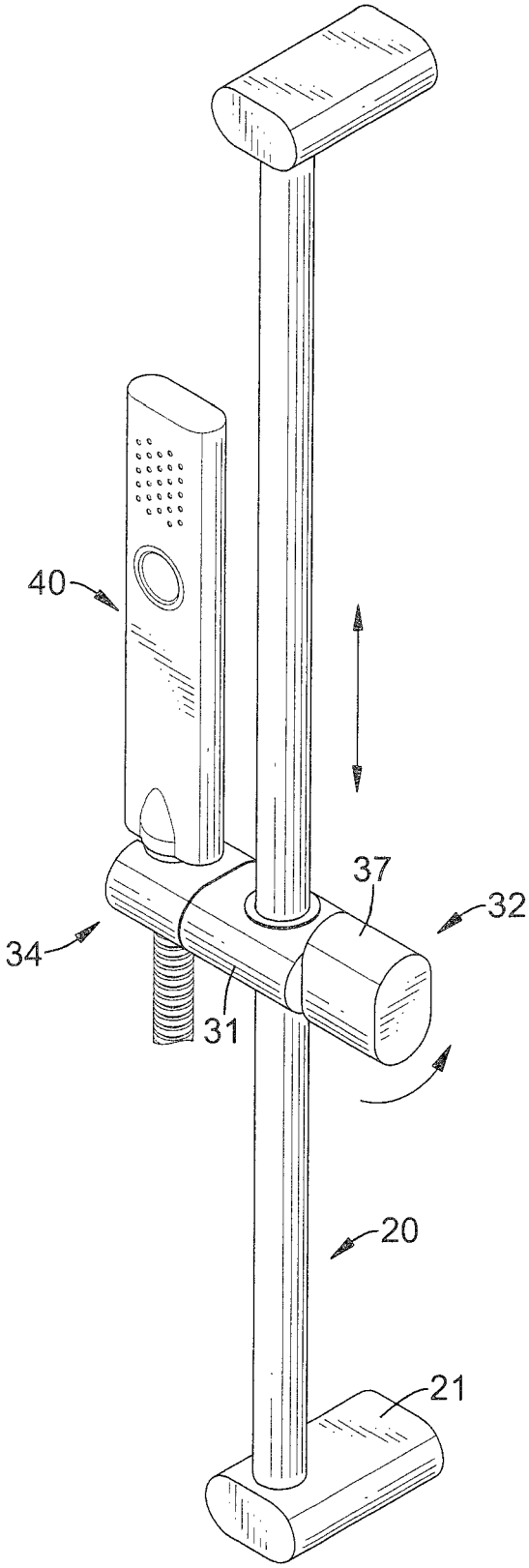
FIG. 4 is an operational perspective view of the slide rail in FIG. 1, shown unlocked.
Figure 5:
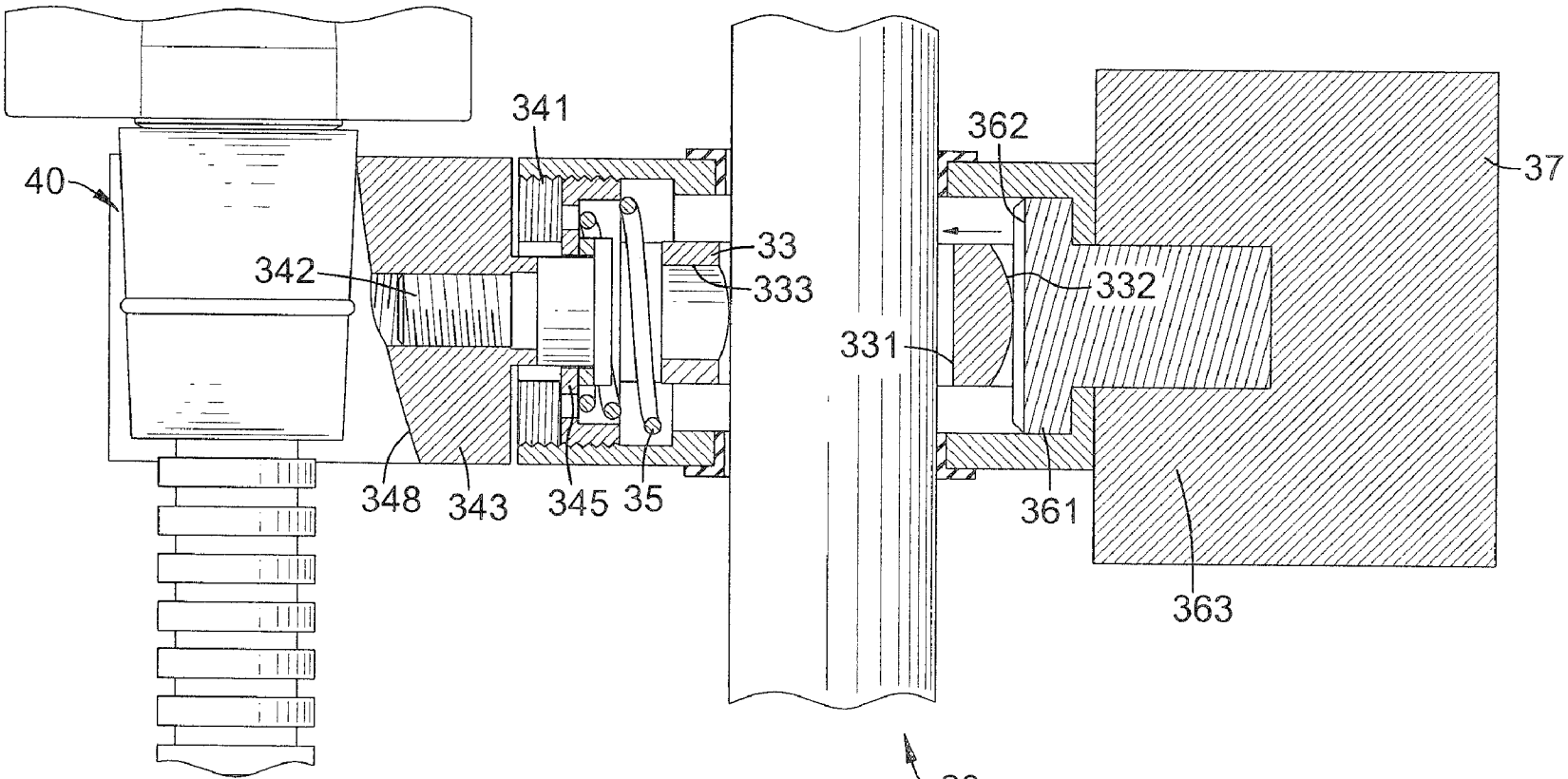
FIG. 5 is an enlarged side view in partial section of the slide rail in FIG. 1, shown unlocked.

With further reference to FIGS. 4 and 5, when the grip (37) and the lock bar (36) of the handle (32) is rotated relative to the clamp (31), the engaging recess (362) of the lock bar (36) will separate from the convex surface (332) of the clamp jaw (33) and the lock bar (36) will push the clamp jaw (33) moving inward to the positioning ring (341) to separate from the external surface of the mounting shaft (20) and press the spring (35). Then, the clamp (31) of the sliding mount (30) can be moved upward or downward relative to the mounting shaft (20) to adjust the position of the sliding mount (30) on the mounting shaft (20). When the sliding mount (30) has been moved to a desired position, the handle (32) is returned to correspond to the clamp (31), the spring (35) will push the clamp jaw (33) to abut the mounting shaft (20) and make the convex surface (332) of the clamp jaw (33) engage the engaging recess (362) of the lock bar (36) as shown in FIG. 3. Then, the sliding mount (30) can be held with the mounting shaft (20) by the clamp jaw (33) abutting with the external surface of the mounting shaft (20).

From the above description, the slide rail (10) has the following advantages.

1. The handle (32) only has to be turned a quarter relative to the clamp (31) to separate the engaging recess (362) from the convex surface (332) and push the clamp jaw (33) away the external surface of the mounting shaft (20), such that operation of adjusting a position of the sliding mount relative to the mounting shaft (20) is convenient and easy.

2. The grip (37) of the handle (32) is an ellipse-shaped corresponding to the clamp (31), so knowing when clamp jaw (33) is abutting the external surface of the mounting shaft (20) or not is easily known by whether the grip (37) corresponds to the clamp (31).

3. Since distinguishing when the clamp jaw (33) is abutting with the external surface of the mounting shaft (20) is easy, this prevents over-rotation of the handle (32) to form a dent on the external surface of the mounting shaft (20).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slide rail having a mounting shaft having an external surface;

two ends; and a diameter; and a sliding mount being movably mounted around the mounting shaft and having a clamp being mounted slidably around the mounting shaft and having
two mounting surfaces;
two ends;
an internal surface;
two mounting holes being respectively formed through the mounting surfaces of the clamp aligned with each other and being mounted around the external surface of the mounting shaft;
a connecting hole being formed in one of the ends of the clamp and communicating with the mounting holes; and
an attaching hole being formed in the other end of the clamp and communicating with the mounting holes and the connecting hole;
a handle being rotatably connected to the clamp and having
a lock bar being rotatably mounted in the connecting hole of the clamp and having
an inner end;
an outer end;
a pressing panel being defined in the inner end of the lock bar, abutting with the internal surface of the clamp near the connecting hole and having
a sidewall facing to the external surface of the mounting shaft; and
an engaging recess being formed on the sidewall of the pressing panel; and
an arm being polygonal, being defined in the outer end of the lock bar and being formed on and protruding from the pressing panel and extending out of the connecting hole of the clamp;
a clamp jaw being mounted in the clamp and around and abutting the mounting shaft and having
a center;
two sidewalls;
a shaft hole being formed through the center of the clamp jaw, being mounted around the external surface of the mounting shaft and having a diameter larger than the diameter of the mounting shaft; and
a convex surface being formed on one of the sidewalls of the clamp jaw and engaging the engaging recess of the pressing panel;
a holding bracket being connected to the clamp near the attaching hole and having a body having a holding recess; and
a spring being mounted in the clamp between the clamp jaw and the holding bracket.

2. The slide rail as claimed in claim 1, wherein the holding bracket further has
a positioning ring being mounted securely in the clamp near the attaching hole;
a fastener being mounted in the clamp and having
an abutting end being mounted in the clamp and abutting the positioning ring; and
a connecting end being extended through the positioning ring and out of the attaching hole of the clamp; wherein
the body is connected to the fastener, abuts the clamp near the attaching hole and has
an inner side;
an outer side; and
a threaded hole being formed in the inner side of the body and being screwed with the connecting end of the fastener to connect the body with the clamp through the fastener,
wherein the holding recess is formed in the outer side of the body.

3. The slide rail as claimed in claim 2, wherein the positioning ring further has a washer abutting the abutting end of the fastener.

4. The slide rail as claimed in claim 3, wherein
the clamp further has
two washers being respectively mounted in the mounting holes; and
an inner thread being formed on the internal surface of the clamp near the attaching hole; and
the positioning ring further has
an external surface; and
an outer thread being formed on the external surface of the positioning ring and being screwed with the inner thread in the internal surface of the clamp near the attaching hole.

5. The slide rail as claimed in claim 4, wherein
the clamp jaw further has a through hole being formed in the clamp jaw at the sidewall opposite to the convex surface and communicating with the shaft hole; and
the fastener further has a polygonal hole being formed in a top of the abutting end of the fastener and aligning with the through hole of the clamp jaw.

6. The slide rail as claimed in claim 5, wherein the handle further has a grip being mounted around the arm of the pressing panel.

7. The slide rail as claimed in claim 6, wherein
the clamp is a hollow and elliptical in cross-section;
the grip has a shape corresponding to the clamp; and
the body of the holding bracket has a shape corresponding to the clamp.

8. The slide rail as claimed in claim 7, wherein the mounting shaft further has two mounting blocks being respectively formed on the ends of the mounting shaft to mount on a wall.

9. The slide rail as claimed in claim 8, wherein the holding recess is formed longitudinally in the outer side of the body to hold a showerhead.

10. The slide rail as claimed in claim 8, wherein the holding recess is formed transversally in the outer side of the body to hold a soap dish.

11. The slide rail as claimed in claim 1, wherein the handle further has a grip being mounted around the arm of the pressing panel.

12. The slide rail as claimed in claim 11, wherein
the clamp is hollow and elliptical in cross-section;
the grip has a shape corresponding to the clamp; and
the body of the holding bracket has a shape corresponding to the clamp.

13. The slide rail as claimed in claim 1, wherein the mounting shaft further has two mounting blocks being respectively formed on the ends of the mounting shaft to mount on a wall.

14. The slide rail as claimed in claim 1, wherein the holding recess is formed longitudinally in the outer side of the body to hold a showerhead.

15. The slide rail as claimed in claim 1, wherein the holding recess is formed transversally in the outer side of the body to hold a soap dish.

* * * * *